US005550429A

United States Patent [19]

Hayama et al.

[11] Patent Number: 5,550,429

[45] Date of Patent: Aug. 27, 1996

[54] DISPLAY DEVICE

[75] Inventors: Hidekazu Hayama, Moriguchi; Yasunori Miura, Takatsuki; Atsushi Suzuki, Nagaokakyo; Keizou Ishiai, Takatsuki, all of Japan

[73] Assignee: Matsushita Electronics Corporation, Osaka, Japan

[21] Appl. No.: 364,107

[22] Filed: Dec. 27, 1994

[30] Foreign Application Priority Data

Dec. 27, 1993 [JP] Japan ..... 5-332597

[51] Int. Cl.[6] ..... H01J 29/86; H01J 29/89

[52] U.S. Cl. ..... 313/479; 313/478; 313/112; 313/111

[58] Field of Search ..... 313/110, 112, 313/478, 479, 111

[56] References Cited

FOREIGN PATENT DOCUMENTS

| | | |
|---|---|---|
| 0112418 | 7/1984 | European Pat. Off. . |
| 0263541 | 4/1988 | European Pat. Off. . |
| 0565026 | 10/1993 | European Pat. Off. . |
| 5-343008 | 12/1993 | Japan . |

OTHER PUBLICATIONS

Patent Abstracts of Japan, vol. 014, No. 252 (E–0934) May 30, 1990 of JP–A–02 072549 Mar. 12, 1990.

Election Components and Applications, "Color monitor tubes with ARAS coatings", J. Rijnders et al., vol. 10, 1990 Eindhoven NL, pp. 85–88.

Sid International Symposium: Digest of Technical Papers, "Combined antistatic and antireflection coating for CRTs", H. KawaMura et al. vol. 20, May 1989 Baltimore, US, pp. 270–273.

H. Tohda et al.; S8—"Anti–Glare, Anti–Reflection and Anti–Static (AGRAS) Coating for CRTs"; Japan Display '92, Oct. 12–14, 1992; pp. 289–292.

*Primary Examiner*—Meshkumar D. Patel

*Attorney, Agent, or Firm*—McDermott, Will & Emery

[57] ABSTRACT

On the outer surface of a glass face panel 1 of a display device, a first layer 2 of an electrically conductive transparent thin film having a high refractive index, and a second layer 3 and a third layer 4 having a low refractive index are deposited as an anti-reflection film. The first layer 2 is formed to have a thickness in a range of 10–20 nm, whereby the surface of the anti-reflection film has a luminous reflectance of 1.5% or less, and a reflectance of 3% or less at a wavelength of 436 nm most prominent light of blue.

5 Claims, 6 Drawing Sheets

DISPLAY DEVICE

FIELD OF THE INVENTION AND RELATED ART STATEMENT

1. Field of the Related Art

The present invention generally relates to a display device, such as a cathode ray tube (CRT) or a plasma display panel, having a face panel which has both functions of anti-static as well as anti-reflection.

2. Description of the Related Art

When ambient light from the room lamp and the like impinges on and is reflected from the outer surface of the glass face panel of the display device, such as the CRT, images produced on the face panel of the display device becomes to be illegible.

In order to cope with such reflection of the ambient light without deteriorating resolution of the images produced on the face panel, and to obtain the anti-static function, it has been a conventional practice to laminate a first thin film having a high refractive index and a second thin film having a low refractive index on the surface of the face panel. These thin films function as an interference film for suppressing the reflection. And the second thin film renders the outer surface to perform a diffused reflection of the ambient light by forming the second thin film as an uneven exposed surface.

Such conventional display device is disclosed in the gazette of the Japanese unexamined patent application (TOKKAI) No. Hei 5-343008 and the proceedings of the twelfth international display research conference (Japan Display '92 October 12–14; Anti-Glare, Anti-Reflection and Anti-Static (AGRAS) coating for CRTs).

The conventional display device disclosed in the gazette TOKKAI No. Hei 5-343008 has the following anti-reflection film comprising a first layer, a second layer and a third layer, which are laminated on the outer surface of the face panel. The first layer is formed by the spin-coating with volatile solution, which is obtained by dissolving a polymer of an alkyl silicate and fine powder of stannic oxide ($SnO_2$) in an alcoholic solvent. The first layer is composed essentially of silicon dioxide ($SiO_2$) and stannic oxide ($SnO_2$) having the high refractive index.

The second layer is formed by the spin-coating with volatile solution of alkyl silicate polymer, which is prepared by dissolving only the alkyl silicate polymer in an alcoholic solvent. The second layer is composed essentially of silicon dioxide ($SiO_2$) having the low refractive index.

The third layer is composed by the same materials as the second layer, and is formed on the second layer by means of spray-coating. The third layer has a crater-like uneven configuration on it's exposed surface. In the crater-like uneven configuration, the convex regions of the third layer are arranged around the concave regions. The concave regions constitute an interference film together with the second layer and the first layer. In other words, the light reflected at the concave regions interferes with the light reflected at a boundary face between the face panel and the first layer as well as the light reflected at a boundary face between the first layer and the second layer. As a result, the ambient light impinging on the concave regions is reflected with suppressed intensity resulting from the interference effect.

The light impinging on the convex regions is reflected irregularly thereby suppressing intensity of the reflected light. Accordingly, the conventional display device has an anti-reflection function which is obtained by the interference film and the diffused reflection film having the crater-like uneven configuration.

It is a fundamental intention for tile anti-reflection film in such conventional display device that the thickness of these coated layers must be selected to reduce minimum reflectance of the light reflected at the concave regions of the third layer or the exposed surfaces of the second layer as low as possible.

In the actual case disclosed in the gazette TOKKAI No. Hei 5-343008, the first layer of $SiO_2$ and $SnO_2$ thin film is formed to have a refractive index of 1.82 on the face panel having a refractive index of 1.54. The second layer of $SiO_2$ thin film is formed to have a refractive index of 1.47. And the third layer is formed by means of spray-coating with the same alkyl silicate polymer volatile solution used for the second layer. This third layer also has a refractive index of 1.47. Since the first layer with the refractive index of 1.82 and the second and the third layers with the refractive index of 1.47 is laminated on the face panel, the thicknesses of respective coated layers are obtained by known calculation, which is disclosed in detail in the assignee's earlier U.S. application Ser. No. 08/041,597 disclosure thereof being combined in this application by referring thereto. In order to reduce the minimum possible reflectance of the light reflected at the outer surface of the display device, that is to make the anti-reflection film having a minimum reflectance of approximately zero, the first layer is set to have a thickness of 76 nm, the second layer is set to have a thickness of 74 nm, and the third layer is set to have an average thickness of 20 nm.

In another prior art case that the first layer is made of only stannic oxide ($SnO_2$), the first layer has a refractive index of 2.0. In this case, the second layer and the third layer are formed by the same material and the same forming means as the above-mentioned case. Therefore, the second and third layers have the refractive index of 1.47. In the conditions of this case, the first layer is formed to have the most suitable thickness, namely 32 nm. The second layer is set to have a thickness of 76 nm, and the third layer is set to have an average thickness 20 nm.

The above-mentioned conventional anti-reflection film having the above-mentioned selected coating thickness has a luminous reflectance L of 1.5%.

The luminous reflectance L is an index designating the intensity of the reflected light being perceivable by the eye. The general luminous reflectance L is given by the following equation:

$$L = \frac{\int_{380}^{780} S(\lambda)\rho(\lambda)d\lambda}{\int_{380}^{780} S(\lambda)d\lambda},$$

where $S(\lambda)$ is the luminosity of human being, namely luminous efficiency which is designated by the function of the sensitivity of human eyes related to the wavelength of the light and $\rho(\lambda)$ is the reflection characteristic. The luminosity $S(\lambda)$ is a ratio of luminous flux to the corresponding radiant flux at a particular wavelength. The reflection characteristic $\rho(\lambda)$ is designated by a function of reflectance related to the wavelength.

The conventional anti-reflection film has lower luminous reflectance L such as 1.5% lower than a surface of the non-coated glass, which has a luminous reflectance L of 4,5%.

The conventional anti-reflection film has a reflection characteristic as shown by a broken line curve 8 in FIG. 6. FIG. 6 is a graph for illustrating a reflection characteristic (broken line 8) of the conventional display device, and a reflection characteristic (curve 9) of a display device of the present invention.

As shown in FIG. 6, the reflection characteristic of the conventional one has a reflectance of 5% or more at a wavelength of 436 nm having the most prominent light of blue. Therefore, the dazzling blue light in the reflected light of the ambient light, such as a fluorescent light, obstructs the images on the face panel of the display device.

FIG. 7 is a graph for illustrating the calculated reflection characteristics of the conventional display device in a simulation. In FIG. 7, the ordinate shows the reflectance [in percentage] and the abscissa shows the wavelength [in nanometer]. A curve 10 shows a spectrum of the light reflected at the exposed surface of the second layer, and a curve 11 shows a spectrum of the light reflected at the convex regions of the third layer. Since the minimum reflectance of each spectrum is set to be substantially zero, each reflection characteristic between the wavelength and the reflectance has a V-shaped curve.

The light reflected from the face panel into eyes of a user becomes a composite light shown by a curve 12 in FIG. 7. Since the composite light (curve 12) is composed of the light (curve 10) reflected at the exposed second layer and the light (curve 11) reflected at the convex regions of the third layer, the minimum value of the reflectance of the composite light becomes higher to about 1.5% on the ordinate of FIG. 7. The reflection characteristic of the composite light 12 still has a V-shaped curve as shown in FIG. 7. As a result, the reflected light, especially the blue light in the visible light, is strongly reflected on the surface of the face panel of the conventional display device.

Since the composite light (curve 12 in FIG. 7) has the spectrum of the V-shaped curve in the reflection characteristic, the coloring of the reflected light is widely changed by just a little change of the thickness of the first and second layers, or of the rate of the concave-convex arrangement of the third layer. If the thicknesses of the coated layers are not controlled exactly at the predetermined value, the coloring of the reflected light is different in each display panel, and/or in each position in the surface of the face panel. Therefore, it is necessary to accurately control the thickness of the coated layer of the display panel. Consequently, the manufacturing capacity for the conventional display device is deteriorated, and the manufacturing cost of it is soared.

OBJECT AND SUMMARY OF THE INVENTION

The present invention purposes and aims to provide a display device which has a remarkable anti-reflection effect in a practical use, and which can suppress the intensity of the reflected light which is offensive to the eye.

In order to achieve the above-mentioned object, a display device in accordance with the present invention comprises:

a face panel;

a first layer which is an electrically-conductive thin film having a first refractive index, and which is deposited on an outer surface of the glass face panel;

a second layer which is a thin film having a second refractive index lower than the first refractive index, and which is deposited on an outer surface of the first layer; and a third layer which is deposited on the second layer and has on its exposed surface a large number of concave regions each surrounded by convex regions in;

wherein the first layer, the second layer and the third layer form an anti-reflection film which has a composite luminous reflectance L of 1.5% or less, and a reflectance of 3% or less at the wavelength of 436 nm.

According to the present invention, the display device has an excellent anti-reflection effect in the whole range of the visible light, and a function which can suppress the intensity of the reflected light. And further, the display device of the present invention has a function suppressing the intensity of the most prominent light which offends the eye. Since the reflection characteristic of the display device of the present invention has a gentle curve in comparison with the reflection characteristic of the conventional display device, the coloring of the reflected light in every point of the surface is little changed if the thickness of the second layer or/and the rate of concave-convex arrangement of the third layer is not accurately controlled. Consequently, the display device of the present invention has an excellent reflection characteristic in a practical use without an accurate thickness control for the coated layers.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the figures are schematic representations for purposes of illustration and do not necessarily depict the actual relative sizes or locations of the elements shown.

DESCRIPTION OF THE PREFERRED EMBODIMENTS

Figure 1:
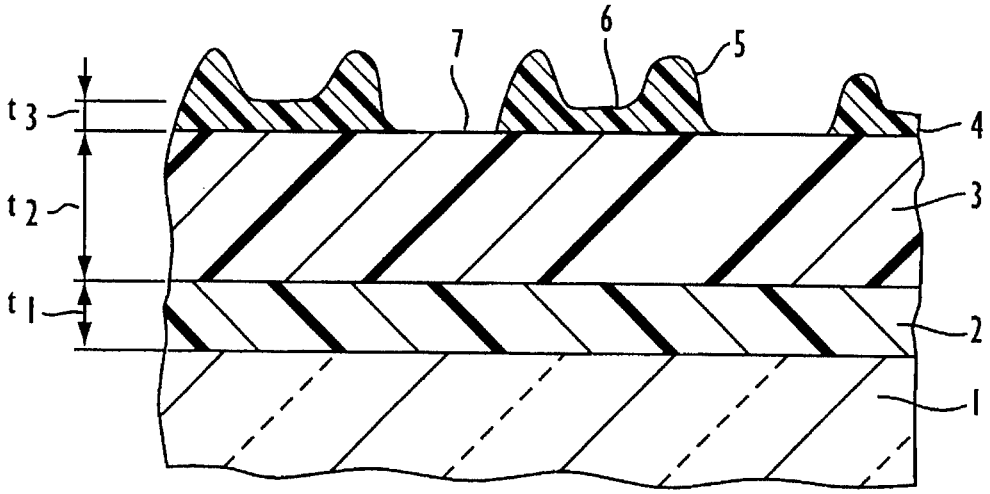
FIG. 1 is a cross-sectional view of an essential part of the face panel of the display device of the present invention.
Figure 2:
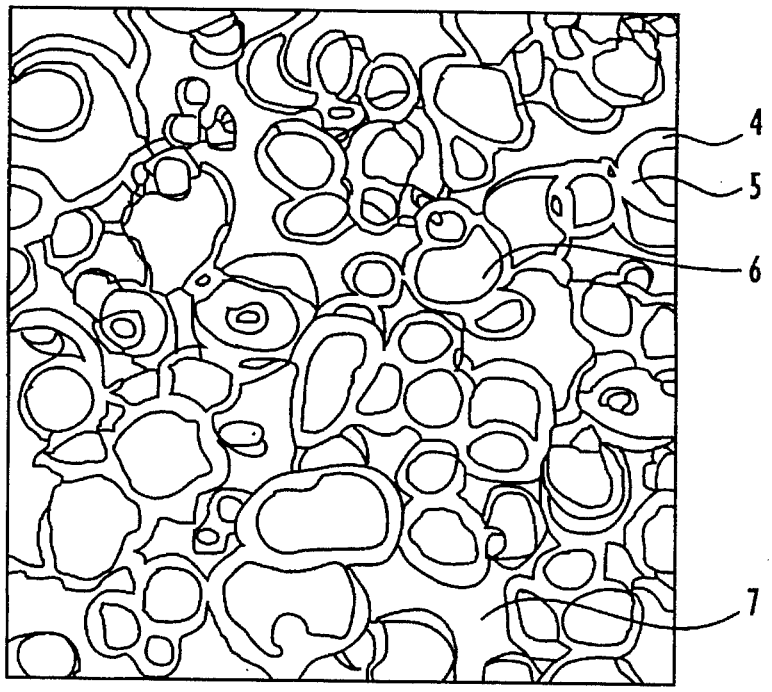
FIG. 2 is an enlarged plan view of the exposed surface of the face panel of the display device of the present invention.
Figure 3:
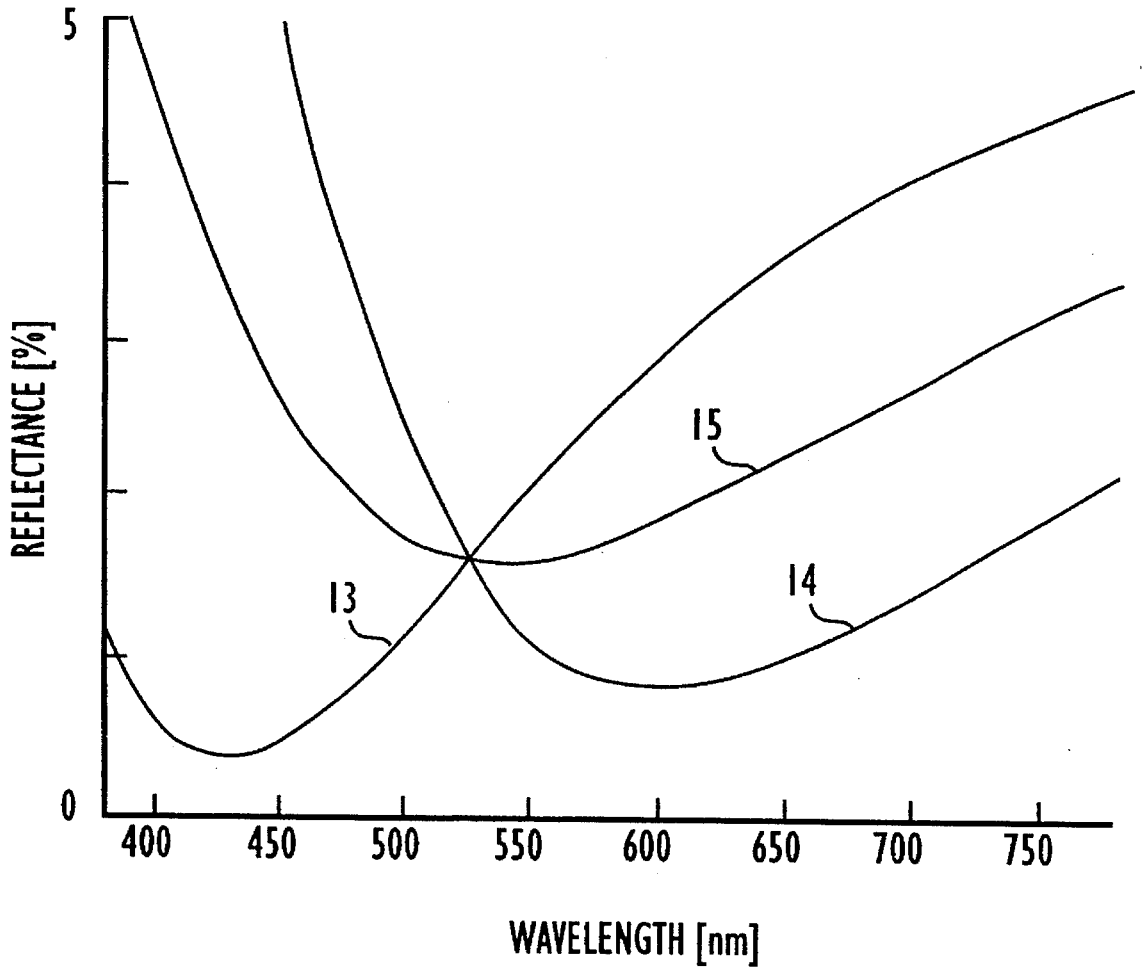
FIG. 3 is a graph for illustrating reflection characteristics obtained by a simulation in the display device of the present invention.

Hereafter, a display device of the present invention will be described with reference to FIGS. 1 to 3. FIG. 1 shows a cross-sectional view of an essential part of the display device. FIG. 2 shows an enlarged plan view of the exposed surface of the display device. FIG. 3 shows a graph for illustrating reflection characteristics of the display device of the present invention. The reflection characteristics in FIG. 3 are calculated by using a computer simulation.

As shown in FIG. 1, a first layer 2 of the thickness $t_1$ having a high refractive index $n_1$ is formed on the outer surface of the face panel 1 by means of chemical vapor deposition (CVD) and drying. And a second layer 3 of the thickness $t_2$ having a low refractive index $n_2$ is formed on the surface of the first layer 2 by means of spin-coating and drying.

A third layer 4 is formed partly on the surface of the second layer 3 by means of spray-coating and heating. The third layer 4 has an uneven net-like pattern configuration with very small crater like ridge-shaped parts on the second layer 3 as shown in FIGS. 1 and 2. The crater like concave regions 6 of third layer 4 have an average thickness $t_3$. The flat surface of the concave region 6 constitutes an interference film together with the second layer 3 as well as the first layer 2.

By the above-mentioned final step of the heat treatment at 400°–450° C. for about 20 min, the first layer 2, the second layer 3 and the third layer 4 are baked firmly on the surface of the face panel.

As shown in FIG. 2, the third layer 4 has the concave regions 6 and convex regions 5 surrounding the concave regions 6. And the rest parts, which are not covered by the third layer 4, are left as the exposed surface 7 of the second layer 3.

And the ambient light impinging on the concave regions 6 is reflected and suppressed intensity by the interference film. The convex regions 5 around the crater-like concave regions 6 reflect the ambient light irregularly.

Figure 7:
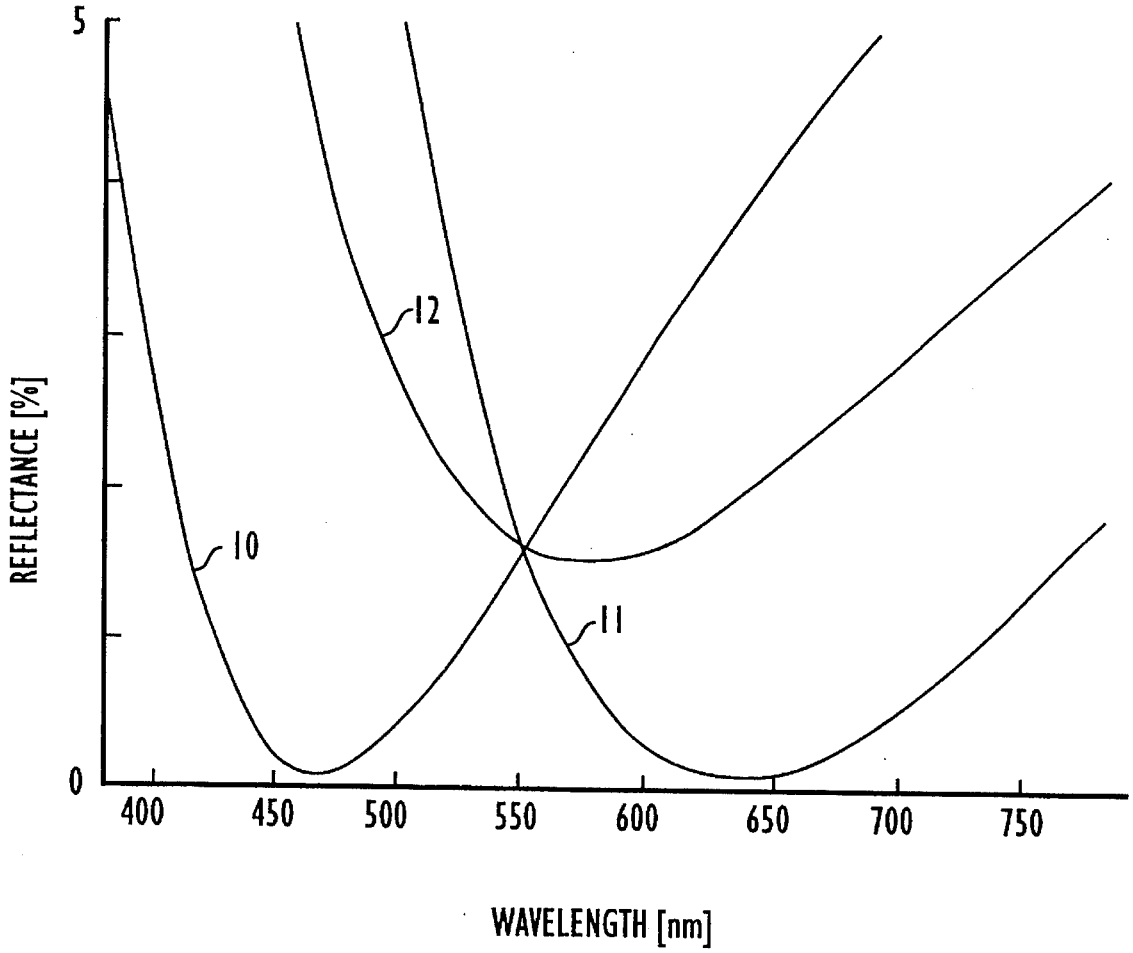
FIG. 7 PRIOR ART
FIG. 7 is the graph for illustrating the reflection characteristics obtained by the simulation in the conventional display device.

The conventional anti-reflection film of the display device was formed under the aforementioned conception that the thickness of respective coated layer was selected to reduce minimum refractive index of the light reflected at the concave regions 6 of the third layer 4 as low as possible. As a result, the reflection characteristic of the conventional anti-reflection film based on the conception had the V-shaped curve as shown in FIG. 7.

On the contrary, an anti-reflection film of the display device in accordance with the present invention is formed under the novel conception which differs significantly from the previous conception. The reflection characteristics of the display device under the new conception are shown by the gently bending curve shown in FIG. 3.

According to our experiments it is confirmed that, for the condition that the light reflected in the practical use is suppressed sufficiently and the prominent color in the reflected light is suppressed to a negligible intensity, the anti-reflection film should be formed to have a luminous reflectance L of 1.5% or less and a reflectance of 3% or less at the wavelength of 436 nm having the most prominent light of blue. This is the reason why these measured values 1.5% and 3% are recited in the claims of the present invention as values to produce the useful result with good reproductibility.

Figure 4:
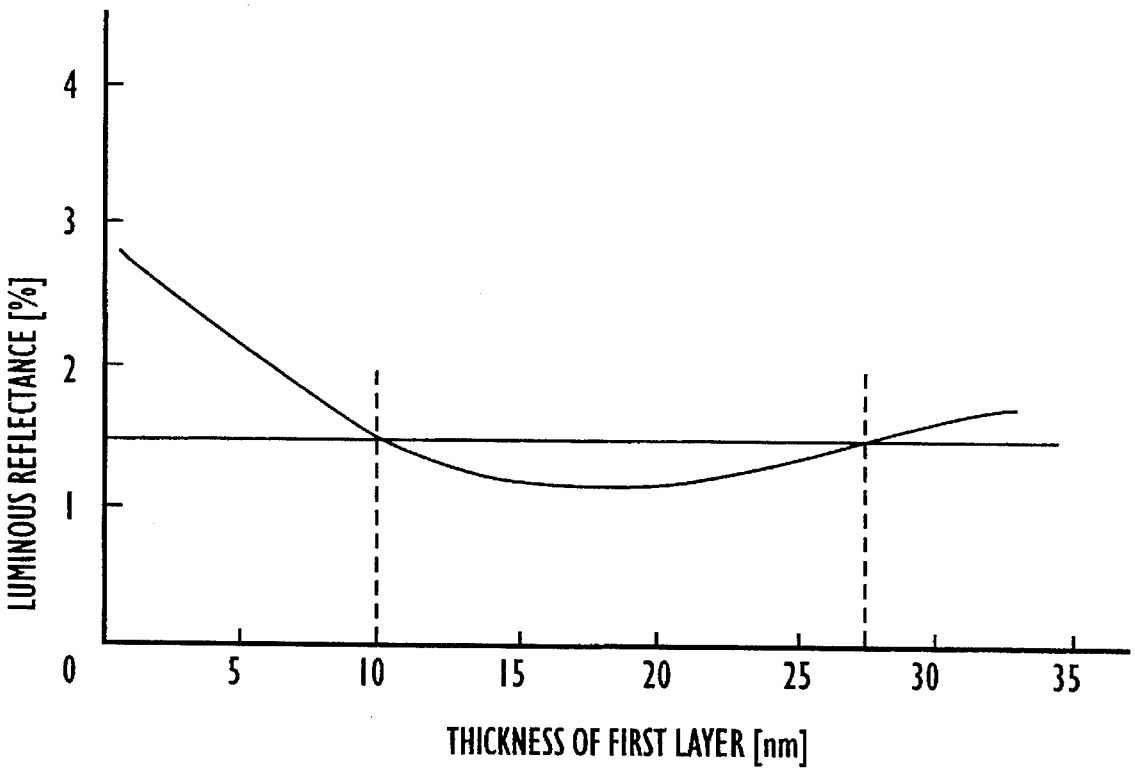
FIG. 4 is a graph for illustrating a relation between a luminous reflectance and a coating thickness of a first layer of the display device of the present invention.

FIG. 4 is a graph showing a relation between the thickness $t_1$ (abscissa) of the first layer 2 and the luminous reflectance L (ordinate) in the anti-reflection film. As shown in FIG. 4, when the first layer 2 has a thickness in the range of about 10 nm–27 nm, the luminous reflectance L is 1.5% or less.

Figure 5:
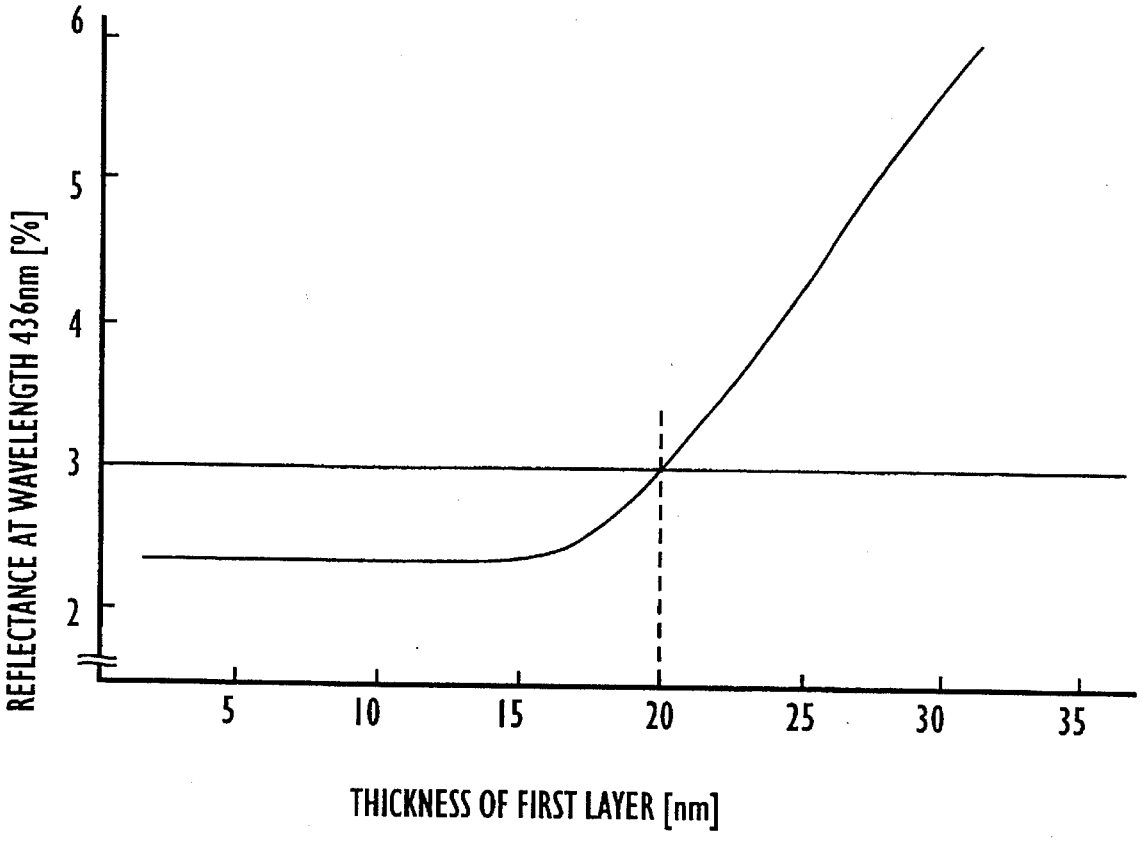
FIG. 5 is a graph for illustrating a relation between a reflectance and the coating thickness of the first layer of the display device of the present invention.

FIG. 5 is a graph showing a relation between the thickness $t_1$ (abscissa) of the first layer 2 and the reflectance (ordinate) at a wavelength of 436 nm. As shown in FIG. 5, when the first layer 2 has a thickness of 20 nm or less, the reflectance at the wavelength of 436 nm is 3% or less. When the anti-reflection film includes the first layer 2 having a thickness over 20 nm, the reflectance at the wavelength of 436 nm of the anti-reflection film increases rapidly.

After the first layer 2 was set to have a thickness of a value in the range of 10 nm–20 nm, the thickness of the second layer 3 is calculated by using a computer simulation, provided that the luminous reflectance L of the anti-reflection film has a specific value of 1.5% or less, and the reflectance at a wavelength of 436 nm of most prominent light of blue has a specific value of 3.0% or less. In the simulation, since the third layer 4 is made of the same material as the second layer 3, the reflection is not produced on the boundary between the second layer 3 and the third layer 4.

In the actual manufacturing process, the third layer 4 is formed to have an average thickness of about 20 nm and to cover about 50% of the surface of the second layer 3 by means of spray-coating. Therefore, in the above-mentioned simulation for calculating the thickness of the second layer 3, the concave regions 6 of the third layer 4 is set to have a thickness of about 40 nm.

In an actual case, when the thickness $t_1$ of the first layer 2 is set to have a value of 10 nm, the optimum thickness $t_2$ of the second layer 3 is obtained as $t_2$=103 nm; or when the thickness $t_1$ of the first layer 2 is set to have a value of 20 nm, the optimum thickness $t_2$ of the second layer 3 is obtained as $t_2$=90 nm.

EXAMPLE

Hereafter, an example of the display device in accordance with the present invention will be described with reference to FIGS. 1 to 3.

The first layer 2 was deposited by means of chemical vapor deposition (CVD) on the outer-surface of the glass face panel 1. The first layer 2 contains stannic oxide ($SnO_2$) as a principal constituent and is doped with antimony (Sb) and is formed uniformly to have the thickness $t_1$ of 15 nm as a transparent conductive thin film. The first layer 2 has a refractive index of 2.0.

Next, in order to function as an interference film with the first layer 2, a second layer 3 having a lower refractive index of 1.45 than that of the first layer 2 is formed on the surface of the first layer 2. The second layer 3 is formed to have a uniform thickness $t_2$ of 97 nm by means of spin-coating with volatile solution. The employed volatile solution for the second layer 3 is prepared by dissolving a polymer of an alkyl silicate in an alcoholic solvent.

A third layer 4 having a low refractive index is formed on the surface of the second layer 3 by means of spray-coating with the volatile solution. The employed volatile solution for the third layer 4 is obtained by dissolving only a polymer of an alkyl silicate in an alcoholic solvent. Since the third layer 4 is made of the same material as the second layer 3, the third layer 4 also has the same lower refractive index of 1.45. Since the third layer 4 is formed by the known spray-coating using a pneumatic atomizer, the third layer 4 is configured to have a net-like pattern comprising uneven configuration with very small crater like ridge-shaped parts constituting convex regions 5 and concave regions 6 as shown in FIG. 2. The obtained concave regions 6 have an average thickness $t_3$ of 41 nm in this example.

And the coated layers are finished as an anti-reflection film by heating at 400°–450° C. for about 20 min. By this heat treatment, the first layer 2, the second layer 3 and the third layer 4 are all baked firmly on the surface of the face panel 1. The glossiness measurement for crater-like uneven exposed surface of the third layer 4 is measured by employing a mirror-finished surface specular glossiness measurement apparatus in accordance with JIS Z8741 (Japanese Industrial Standard No. Z8741). During this measurement, the incident angle of the light to the surface of the example is fixed to 60 degrees. By this measurement, the example has a glossiness of about 75 in the reflected light. In the exposed surface of the example of the display device, an area ratio of the concave regions 6 to the exposed surface 7 of the second layer 3 is set about 1 to 1.

In the above-mentioned example, the anti-reflection film has the first layer 2 of $SnO_2$ having the high refractive index of 2.0, and the second and third layers 3 and 4 of $SiO_2$ having the low refractive index of 1.45.

FIG. 3 shows computer simulated curves for illustrating reflection characteristics of the display device in accordance with the present invention.

The computer simulated curves 13, 14 and 15 are obtained in case of the first layer 2 having a thickness of 15 nm. In FIG. 3, the curve 13 shows a spectrum of the light reflected at the exposed surface 7 of the second layer 3, and the curve 14 shows a spectrum of the light reflected at the concave regions 6 of the third layer 4. And the curve 15 shows a spectrum of the composite light which is composed of the reflected light having the spectrum shown by the curve 13 and the reflected light having the spectrum shown by the curve 14. As shown in FIG. 3, the spectrum shown by the curve 13 has the minimum reflectance of 0.3%, and the spectrum shown by the curve 14 has the minimum reflectance of 0.8%. Curves of these spectrums curve more gently than the aforementioned V-shaped curve shown in FIG. 7. The composite light of the spectrum shown by the curve 15 has the minimum reflectance of 1.6% the substantially same value as of the aforementioned conventional anti-reflection film.

Figure 6:
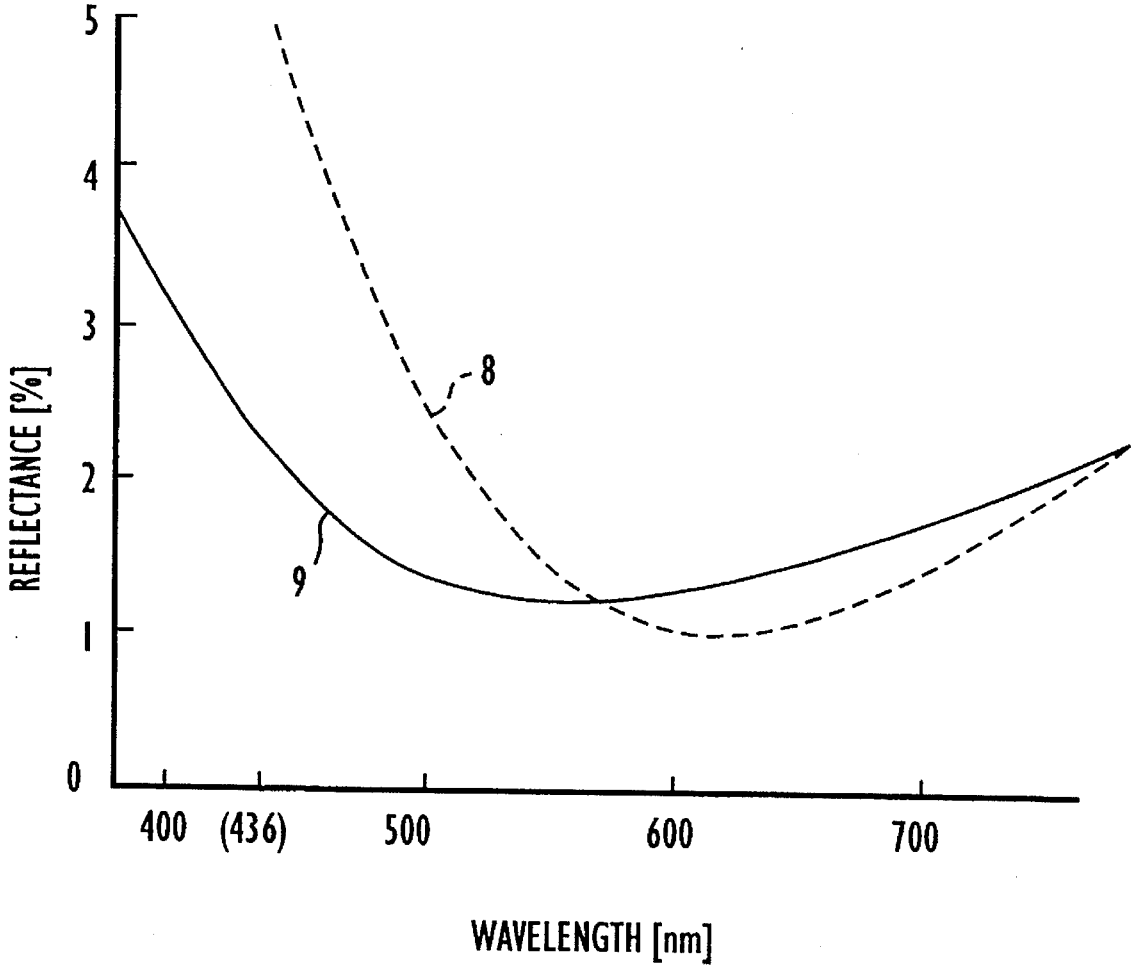
FIG. 6 is a graph for illustrating reflection characteristics obtained by measurement in the conventional display device and the display device of the present invention.

The reflection characteristic shown by the computer-simulated curve 15 in FIG. 3 has a higher reflectance than the measured reflection characteristic shown by the curve 9 in FIG. 6. The reason why is that the intensity of the reflected light is suppressed by the irregular reflection of the outer light which impinges on the convex regions 5 of the third layer 4.

Apart from the above-mentioned example wherein the film forming material employed for the first layer 2 is stannic oxide ($SnO_2$), a modified embodiment may be such that the film forming material employed for the first layer is indium sesquioxide ($In_2O_3$). Though these coated layers of the stannic oxide ($SnO_2$) and the indium sesquioxide ($In_2O_3$) have a refractive index of about 2.0, the first layers of $SnO_2$ and $In_2O_3$ have some different values of the refractive index. In the manufacturing process of CVD for forming the first layer 2, antimony (Sb) is doped to the stannic oxide layer, or tin (Sn) is doped to the indium sesquioxide layer. As a result, the first layer of $SnO_2$ or $In_2O_3$ has the variation of its refractive index according to the quantity of the doped antimony (Sb) or tin (Sn). However, the change of the reflection characteristic owing to the variation of the refractive index can be adjusted by controlling the thickness of the first layer 2.

In the above-mentioned example, the first layer 2 is formed by means of CVD, the second layer 3 is formed by means of spin-coating and the third layer 4 is formed by means of spray-coating. But apart therefrom, a modified embodiment may be such that the first and second layers are formed as uniformly coated film by means of dip-coating or spattering, and the third layer is formed so as to have preferable configuration by means of dip-coating or spattering.

Apart from the above-mentioned example wherein the face panel is made of glass, a modified embodiment may be such that the face panel is made of heat-resistant resin.

FIG. 6 shows curve 9 obtained by measurement of the reflection characteristic of the light reflected at the above-mentioned anti-reflection film of the display device in accordance with the present invention. The anti-reflection film having the reflection characteristic shown in FIG. 6 has the luminous reflectance L of 1.2%. Therefore, the anti-reflection film suppresses sufficiently the intensity of the reflected light.

And the reflectance at the wavelength of 436 nm having the most prominent light of blue is about 2.4% as shown in FIG. 6. The curve 9 for the reflection characteristic shows a considerably low reflectance in the whole range of the visible light region, namely a gently bending curve. Consequently, the anti-reflection film in accordance with the present invention can suppress the offensive color in the reflected light.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A display device comprising:

a glass face panel;

a first layer, which is an electrically-conductive thin film having a first refractive index, which is deposited on an outer surface of said glass face panel;

a second layer, which is a thin film having a second refractive index lower than said first refractive index, and which is deposited on an outer surface of said first layer; and a third layer, which is deposited on said second layer, and which has an exposed surface having a large number of concave regions and convex regions;

wherein said first layer, said second layer and said third layer form an anti-reflection film which has a composite luminous reflectance of 1.5% or less, and a reflectance of 3% or less at a wavelength of 436 nm.

2. The display according to claim 1, wherein said first layer has a thickness in a range of 10 to 20 nm, and a refractive index of about 2.0.

3. The display device according to claim 1 or 2, wherein said first layer of a transparent thin film comprises at least one member selected from the group consisting of stannic oxide ($SnO_2$) or indium sesquioxide ($In_2O_3$) as a principal constituent.

4. The display device according to claim 1 or 2, wherein said second layer of a transparent thin film is made of silicon dioxide ($SiO_2$) as a principal constituent.

5. The display according to claim 1 or 2, wherein said third layer is arranged to have an area ratio of said concave regions to an exposed surface of said display device of about 50%, and which is made of the same material as said second layer.

* * * * *

UNITED STATES PATENT AND TRADEMARK OFFICE

CERTIFICATE OF CORRECTION

PATENT NO. : 5,550,429

DATED : August 27, 1996

INVENTOR(S) : Hidekazu HAYAMA et al.

It is certified that error appears in the above-indentified patent and that said Letters Patent is hereby corrected as shown below:

Col.8, Line 46, After "film" insert --,--

Col.8, Line 49, After "display" insert --device--

Col.8, Line 60, After "display" insert --device--

Signed and Sealed this

Twenty-ninth Day of September, 1998

*Attest:*

*Attesting Officer*

BRUCE LEHMAN

*Commissioner of Patents and Trademarks*